US009114418B2

(12) United States Patent
Donnay et al.

(10) Patent No.: US 9,114,418 B2
(45) Date of Patent: Aug. 25, 2015

(54) WORKING TANK WITH VACUUM ASSIST

(75) Inventors: John Donnay, Fenton, MI (US); George B. Byma, Clarkston, MI (US)

(73) Assignee: Android Industries LLC, Auburn Hills, MI (US)

( * ) Notice: Subject to any disclaimer, the term of this patent is extended or adjusted under 35 U.S.C. 154(b) by 752 days.

(21) Appl. No.: 13/338,510

(22) Filed: Dec. 28, 2011

(65) Prior Publication Data

US 2012/0167921 A1 Jul. 5, 2012

Related U.S. Application Data

(60) Provisional application No. 61/428,128, filed on Dec. 29, 2010.

(51) Int. Cl.

| | |
|---|---|
| ***B05C 3/02*** | (2006.01) |
| ***B05C 11/10*** | (2006.01) |
| ***B05C 3/109*** | (2006.01) |

(52) U.S. Cl.

CPC . *B05C 3/109* (2013.01); *B05C 3/02* (2013.01); *B05C 11/101* (2013.01)

(58) Field of Classification Search

CPC ..... B05C 3/02; B05C 3/109; B05C 11/109
USPC ..... 427/294; 134/21
See application file for complete search history.

(56) References Cited

U.S. PATENT DOCUMENTS

| | | | |
|---|---|---|---|
| 3,863,706 | A | 2/1975 | Chandley et al. |
| 4,109,612 | A | 8/1978 | Mayer |
| 4,340,108 | A | 7/1982 | Chandley et al. |
| 4,508,157 | A | 4/1985 | Belliveau et al. |
| 4,550,034 | A | 10/1985 | Shimrock et al. |
| 4,616,691 | A | 10/1986 | Voss |
| 4,632,171 | A | 12/1986 | Almond |
| 4,641,703 | A | 2/1987 | Voss et al. |
| 4,660,345 | A | 4/1987 | Browning |
| 4,745,962 | A | 5/1988 | Mercer et al. |
| 4,825,933 | A | 5/1989 | Voss et al. |
| 4,828,011 | A | 5/1989 | Hafer et al. |
| 4,848,439 | A | 7/1989 | Plant |

(Continued)

FOREIGN PATENT DOCUMENTS

JP 2005161268 A 6/2005

OTHER PUBLICATIONS

International Search Report for PCT/US2011/067345 dated Aug. 28, 2012.

*Primary Examiner* — Michael Kornakov
*Assistant Examiner* — Natasha Campbell
(74) *Attorney, Agent, or Firm* — Honigman Miller Schwartz and Cohn LLP

(57) ABSTRACT

A system is disclosed. The system includes a fluid reservoir containing a volume of fluid, a bell housing that forms a chamber, a workpiece having a first surface portion and a second surface portion, and a pressure manipulating subsystem in fluid communication with the chamber of the bell housing. The bell housing is arranged relative to the fluid reservoir such that a lower end of the bell housing is at least partially submerged in the fluid thereby sealing the chamber of the bell housing from atmosphere. The bell housing is arranged relative to the fluid reservoir such that the second surface portion of the workpiece is disposed within the chamber of the bell housing that is sealed from atmosphere. A method is also disclosed. An apparatus is also disclosed.

2 Claims, 16 Drawing Sheets

(56) References Cited

U.S. PATENT DOCUMENTS

| | | | |
|---|---|---|---|
| 4,858,672 | A | 8/1989 | Chandley |
| 4,862,945 | A | 9/1989 | Greanias et al. |
| 4,862,946 | A | 9/1989 | Chandley |
| 4,865,113 | A | 9/1989 | Voss et al. |
| 4,874,029 | A | 10/1989 | Chandley |
| 4,901,781 | A | 2/1990 | Ruff |
| 4,922,992 | A | 5/1990 | Sabraw |
| 4,957,153 | A | 9/1990 | Chandley |
| 4,961,455 | A | 10/1990 | Redemske et al. |
| 4,965,099 | A | 10/1990 | Bornhorst |
| 4,971,131 | A | 11/1990 | Aubin et al. |
| 4,977,946 | A | 12/1990 | Borrousch et al. |
| 4,977,948 | A | 12/1990 | Chandley |
| 4,982,777 | A | 1/1991 | Chandley |
| 4,989,662 | A | 2/1991 | Sabraw |
| 4,993,473 | A | 2/1991 | Newcomb |
| 5,029,630 | A | 7/1991 | Voss |
| 5,035,277 | A | 7/1991 | Kubisch |
| 5,038,846 | A | 8/1991 | Doty |
| 5,044,420 | A | 9/1991 | VanderJagt |
| 5,062,466 | A | 11/1991 | Kubisch et al. |
| 5,062,467 | A | 11/1991 | Kubisch et al. |
| 5,069,271 | A | 12/1991 | Chandley et al. |
| 5,070,930 | A | 12/1991 | Kubisch et al. |
| 5,088,546 | A | 2/1992 | Greanias et al. |
| 5,113,924 | A | 5/1992 | Green et al. |
| 5,161,604 | A | 11/1992 | Chandley et al. |
| 5,174,356 | A | 12/1992 | VanderJagt |
| 5,271,451 | A | 12/1993 | Chandley et al. |
| 5,706,880 | A | 1/1998 | Ohnuma et al. |

WORKING TANK WITH VACUUM ASSIST

RELATED APPLICATIONS

This Application claims the benefit of U.S. Provisional Application 61/428,128 filed on Dec. 29, 2010, which is entirely incorporated herein by reference.

FIELD OF THE INVENTION

The disclosure relates to a system and method including a workpiece submergable in a fluid and an apparatus for carrying out the submerging of the workpiece in the fluid.

DESCRIPTION OF THE RELATED ART

It is known that a manufacturer utilizes tooling in order to produce a product. Therefore, a need exists for the development of improved tooling and methods that advance the art.

BRIEF DESCRIPTION OF THE DRAWINGS

The disclosure will now be described, by way of example, with reference to the accompanying drawings, in which.

DETAILED DESCRIPTION OF THE INVENTION

Figure 1B:
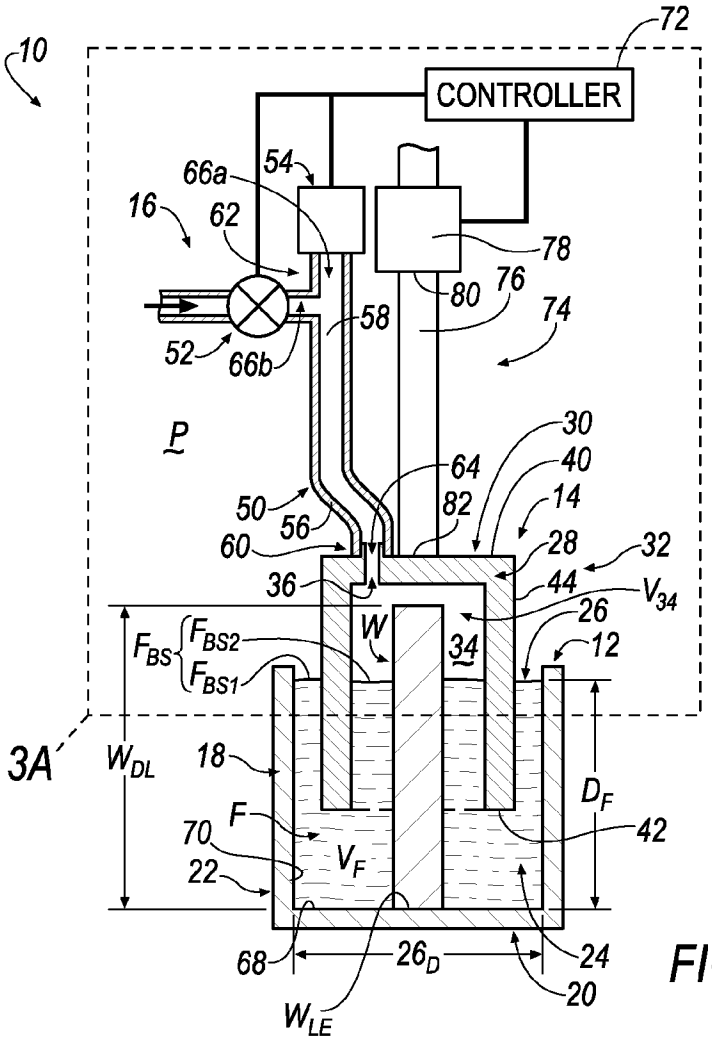
FIGS. 1A-1F illustrate partial cross-sectional views of a system including a workpiece submergable in a fluid.

The figures illustrate an exemplary implementation of a system and method including a workpiece submergable in a fluid and an apparatus for carrying out the submerging of the workpiece in the fluid. Based on the foregoing, it is to be generally understood that the nomenclature used herein is simply for convenience and the terms used to describe the invention should be given the broadest meaning by one of ordinary skill in the art.

Referring to FIGS. 1A-1F, a system is shown generally at 10 in accordance with an exemplary embodiment of the invention. The system 10 includes a workpiece, W, submergable in a volume, $V_F$, of fluid, F, in accordance with an exemplary embodiment of the invention. In an embodiment, the system 10 further includes a fluid reservoir 12 that contains the volume, $V_F$, of fluid, F, a bell housing 14 and a pressure manipulating sub-system 16 that is in fluid communication with the bell housing 14.

The Fluid Reservoir 12

The fluid reservoir 12 may include a body 18 that is formed by a base portion 20 and at least one sidewall portion 22 connected to the base portion 20. The base portion 20 and the at least one sidewall portion 22 forms a cavity 24 for containing the volume, $V_F$, of fluid, F, in the fluid reservoir 12.

The at least one sidewall portion 22 forms an opening 26 in the body 18. The opening 26 includes a dimension, $\mathbf{26}_D$. The opening 26 in the body 18 permits access to the cavity 24. Further, as will be explained in the following disclosure, when the volume, $V_F$, of fluid, F, is disposed in the cavity 24, the opening 26 permits access to a break surface, $F_{BS}$, of the fluid, F.

The Bell Housing 14

The bell housing 14 may include a body 28 that is formed by a base portion 30 and at least one sidewall portion 32 connected to the base portion 30. The base portion 30 and the at least one sidewall portion 32 forms a chamber 34.

The base portion 30 forms a first opening 36 in the body 28 of the bell housing 14. The at least one sidewall portion 32 forms a second opening 38 in the body 28 of the bell housing 14.

The body 28 of the bell housing 14 includes an outer upper end surface 40 and an outer lower end surface 42. The outer upper end surface 40 may be formed by the base portion 30 of the body 28 of the bell housing 14. The outer lower end surface 42 may be formed by the at least one sidewall portion 32 of the body 28 of the bell housing 14. The outer lower end surface 42 may alternatively be referred to as a lip of the bell housing 14.

The outer upper end surface 40 and the outer lower end surface 42 may be utilized to reference a length dimension, $\mathbf{14}_{DL}$, of the bell housing 14. Further, one or more outer side surfaces 44 of the at least one sidewall portion 32 may be utilized to reference a width dimension, $\mathbf{14}_{DW}$, of the bell housing 14. The one or more outer side surfaces 44 extend between and connect the outer upper end surface 40 to the outer lower end surface 42.

The body 28 of the bell housing 14 may be further described to include an inner upper end surface 46 and one or more inner side surfaces 48. The inner upper end surface 46 and the one or more inner side surfaces 48 define a volume, $V_{34}$, of the chamber 34 of the bell housing 14.

The inner upper end surface 46 may be formed by the base portion 30 of the body 28 of the bell housing 14. The one or more inner side surfaces 48 may be formed by the at least one sidewall portion 32 of the bell housing 14. The one or more inner side surfaces 48 extend between and connect the inner upper end surface 46 to the outer lower end surface 42.

The Pressure Manipulating Sub-System 16

The pressure manipulating sub-system 16 may include a conduit 50, a valve 52 and a vacuum pump 54. The valve 52 and vacuum pump 54 are both connected to and are in fluid communication with the conduit 50.

The conduit 50 includes a substantially tubular body 56 defining a passage 58 that extends through the conduit 50 from a first end 60 of the conduit 50 to a second end 62 of the conduit 50. The first end 60 of the conduit 50 forms a first opening 64 that permits access to the passage 58 extending through the substantially tubular body 56. The second end 62 of the conduit 50 forms one or more second openings 66*a*, 66*b* that permits access to the passage 58 extending through the substantially tubular body 56.

The first end 60 of the conduit 50 is aligned with the first opening 36 formed by the base portion 30 of the body 28 of the bell housing 14. Further, the first end 60 of the conduit 50 is sealingly-connected to the upper end surface 40 formed by the base portion 30 of the body 28 of the bell housing 14 such that the chamber 34 of the bell housing 14 is in fluid communication with the passage 58 of the conduit 50. Accordingly, the chamber 34 may said to be in fluid communication with one or more of the valve 52 and the vacuum pump 54 by way of the conduit 50 at the second opening 66*a*, 66*b*.

The Volume, $V_F$, of Fluid, F

Figure 1A:
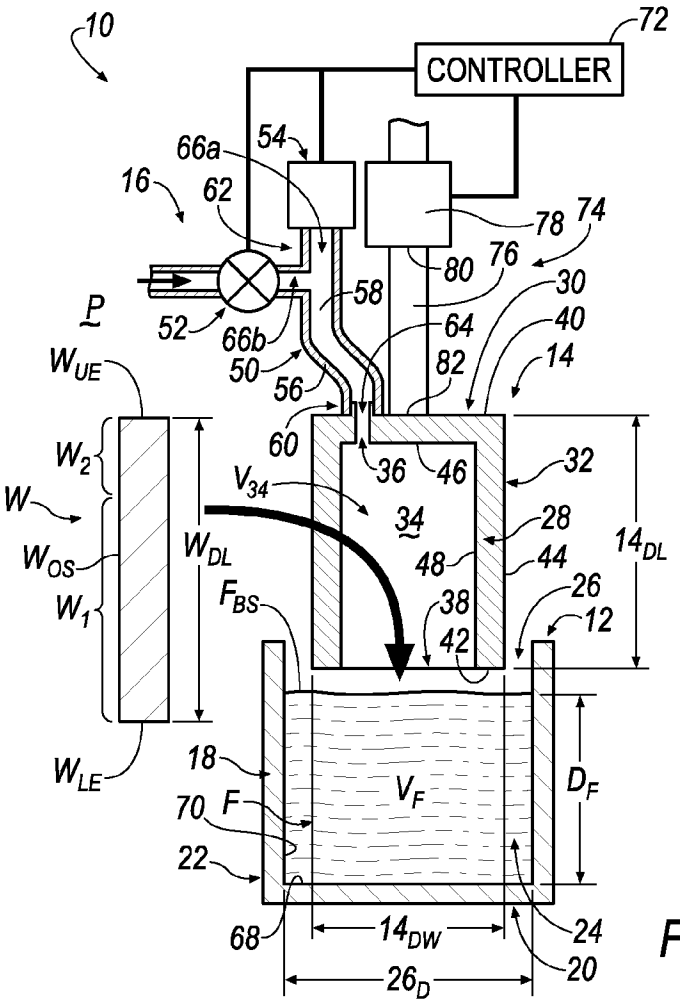

As illustrated in FIG. 1A, the volume, $V_F$, of fluid, F, is disposed in the cavity 24 of the fluid reservoir 12. Because of gravity, the fluid, F, spreads and may contact at least a portion of an inner surface 68, 70 of each of the base portion 20 and the at least one sidewall portion 22 of the fluid reservoir 12. Further, when the volume, $V_F$, of fluid, F, is disposed in the cavity 24, some of the fluid, F, may be exposed to atmospheric pressure, P, and thereby forms what may be referred to as the "fluid break surface," $F_{BS}$; accordingly, as will be described in the following disclosure, when a foreign object (e.g., the workpiece, W, the bell housing 14, or the like) is inserted into the fluid, F, the foreign object may be described to "break through" the fluid break surface, $F_{BS}$, that is formed by the fluid, F.

With continued reference to FIG. 1A, an amount of fluid, F, disposed within the cavity 24 results in the fluid break surface, $F_{BS}$, being spaced away from the inner surface 68 of the base portion 20 at a distance, $D_F$. The distance, $D_F$, may alternatively be referred to as a depth of the fluid, F, disposed within the cavity 24.

Referring to FIG. 1B, upon inserting at least a portion of a volume of one or more of the workpiece, W, and the bell housing 14 into the fluid, F, a corresponding volume of fluid, F, is displaced within the cavity 24 toward the opening 26, and, as a result, the fluid break surface, $F_{BS}$, is further spaced away from the inner surface 68 of the base portion 20 thereby defining a greater distance, $D_F$, when compared to what is shown in FIG. 1A.

Further, as will be explained in greater detail in the following disclosure, insertion of the bell housing 14 into the fluid, F, results in the fluid break surface, $F_{BS}$, being partitioned so as to form a first fluid break surface portion, $F_{BS1}$ (see, e.g., FIG. 1B), and a second fluid break surface portion, $F_{BS2}$ (see, e.g., FIG. 1B). The first fluid break surface portion, $F_{BS2}$, is exposed to atmospheric pressure, P, whereas the second fluid break surface portion, $F_{BS2}$, is sealingly-isolated from atmospheric pressure, P, by the chamber 34 of the bell housing 14.

The System 10

With reference to FIGS. 1A-1F, a methodology 100 (see FIG. 5) in conjunction with the system 10 is described according to an embodiment. In an embodiment, the system 10 may further include a controller 72 for carrying out the methodology 100.

In an embodiment, the controller 72 may include, for example, logic circuitry for operating the system 10 in an automated manner. Alternatively, in an embodiment, the controller 72 may include, for example, one or more joysticks and buttons for operating the system 10 in a manual manner. Alternatively, in an embodiment, the controller 72 may include one or more of logic circuitry, joysticks, buttons or the like for operating the system 10 in a compounded automated/manual, or, one or more of a selectable automated and manual fashion.

Figure 5:
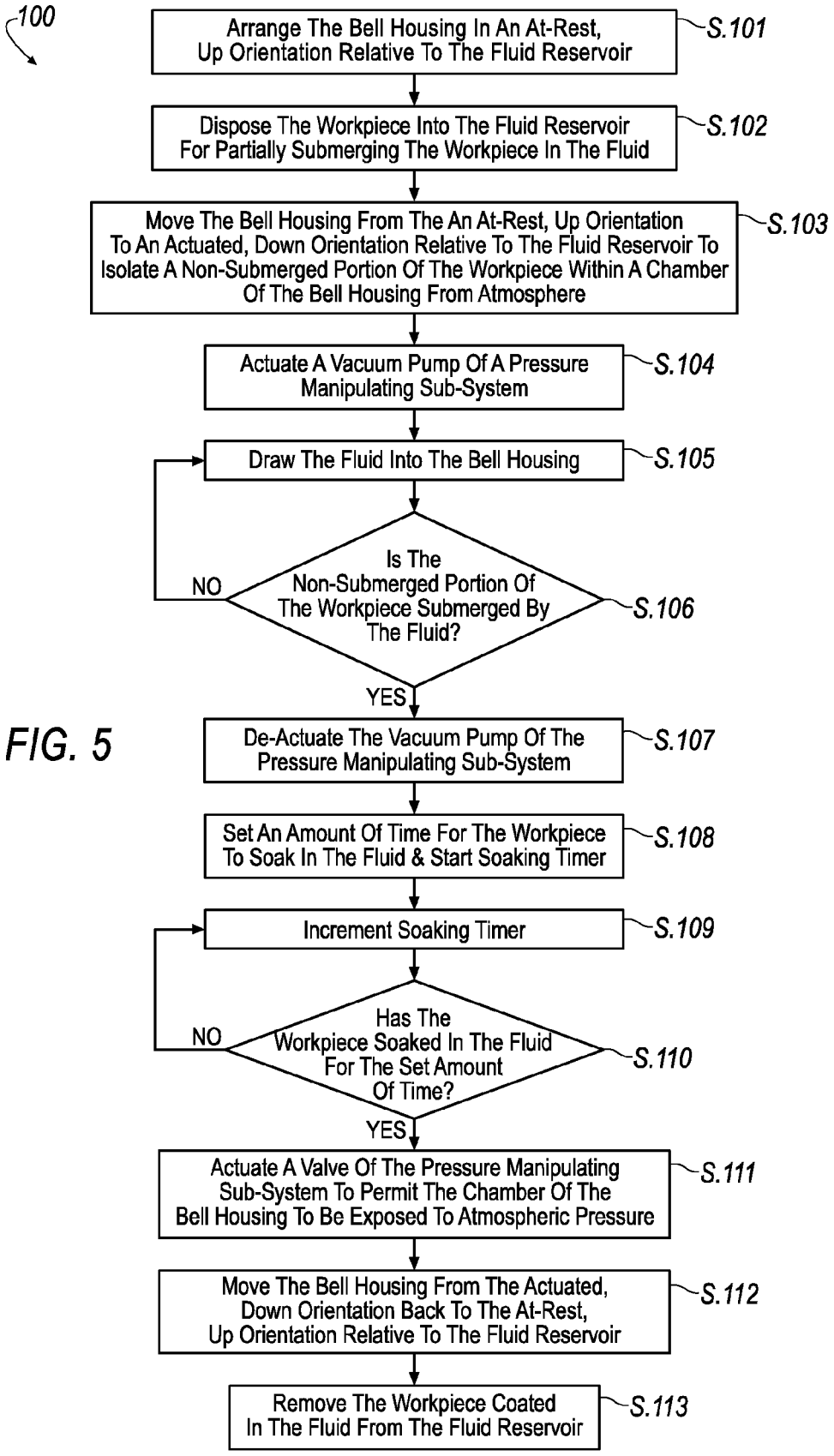
FIG. 5 illustrates a methodology associated with the system of FIGS. 1A-1F.

Referring initially to FIG. 1A, the bell housing 14 is arranged in an at-rest, "up orientation" relative to the fluid reservoir 12 (see, e.g., step S.101 in FIG. 5). Conversely, as seen in FIG. 1B, the bell housing 14 is arranged in an actuated, "down orientation" relative to the fluid reservoir 12 (see, e.g., step S.103 in FIG. 5). The up/down orientation of the bell housing 14 is carried out by a plunging device 74 that is connected to the controller 72.

In an embodiment, the plunging device 74 includes a boom 76 that is connected to a motor 78. The boom 76 includes an upper end 80 and a lower end 82. The upper end 80 of the boom 76 is connected to the motor 78 and the lower end 82 is connected to the outer upper end surface 40 of the body 28 of the bell housing 14.

Initially, the bell housing 14 is arranged in the at-rest, up orientation (see, e.g., step S.101 in FIG. 5) in order to provide access to the opening 26 formed in the body 18 of the fluid reservoir 12. Access to the opening 26 permits disposal of the workpiece, W, into the cavity 24 of the fluid reservoir 12.

The workpiece, W, is inserted into the cavity 24 (see, e.g., step S.102 in FIG. 5) such that a lower end, $W_{LE}$, of the workpiece, W, is permitted to break through the fluid break surface, $F_{BS}$, of the fluid, F. The workpiece, W, is advanced further into the fluid, F, until the lower end, $W_{LE}$, of the workpiece, W, contacts the inner surface 68 of the base portion 20 of the fluid reservoir 12.

As illustrated, the workpiece, W, includes a length dimension, $W_{DL}$. The length dimension, $W_{DL}$, is referenced from an upper end, $W_{UE}$, and the lower end, $W_{LE}$, of the workpiece, W. In an implementation, it desirable to fully submerge the workpiece, W, in the fluid, F, such that the fluid, F, may fully coat an outer surface, $W_{OS}$, of the workpiece, W; however, because the length dimension, $W_{DL}$, of the workpiece, W, is greater than the dimension, $26_D$, of the opening 26 formed in the body 18 of the fluid reservoir 12, a change of orientation of the workpiece, W, within the fluid reservoir 12 (i.e., changing the orientation of the workpiece, W, from a substantially "upright orientation" as illustrated to a "knocked down" or "side orientation") is physically impossible. Accordingly, upon disposing the workpiece, W, within the fluid reservoir 12, some of the workpiece, W, may extend through the opening 26 and out of the cavity 24 of the fluid reservoir 12. Thus, in an implementation, when the workpiece, W, is arranged, for example, in the substantially "upright orientation," a first portion, $W_1$ (see FIG. 1A), of the workpiece, W, may be submerged (see FIG. 1B) by the fluid, F, while a second portion, $W_2$ (see FIG. 1A), of the workpiece, W, may not be submerged (see FIG. 1B) by the fluid, F, and may extend out of the cavity 24 of the fluid reservoir 12.

Referring to FIG. 1B, in order to fully submerge the workpiece, W, in the fluid, F, the bell housing 14 is moved from the at-rest, "up orientation" to the actuated, "down orientation" (see, e.g., step S.103 in FIG. 5). When the bell housing 14 is moved to the down orientation, the lower end surface 42 of the body 28 of the bell housing 14 is permitted to break through the fluid break surface, $F_{BS}$, of the fluid, F. Further, when arranged in the "down orientation," some of the of the chamber 34 of the bell housing 14 may extend out of the cavity 24 and through the opening 26 and of the fluid reservoir 12 such that some of the volume, $V_{34}$, of the chamber 34 of the bell housing 14 is arranged within the cavity 24 while some of the volume, $V_{34}$, of the chamber 34 of the bell housing 14 is not arranged within the cavity 24.

Upon the lower end surface 42 of the body 28 of the bell housing 14 being arranged in a manner so as to break through the fluid break surface, $F_{BS}$, the fluid break surface, $F_{BS}$, is partitioned so as to form the first fluid break surface portion, $F_{BS1}$, and the second fluid break surface portion, $F_{BS2}$, as described above. Further, upon the lower end surface 42 of the body 28 of the bell housing 14 being arranged in a manner so as to break through the fluid break surface, $F_{BS}$, of the fluid, F, the second portion, $W_2$, of the workpiece, W, that is not submerged by the fluid, F, is arranged within the chamber 34 of the bell housing 14. Yet even further, when the second portion, $W_2$, of the workpiece, W, is arranged within the chamber 34 of the bell housing 14, and, when the bell housing 14 is arranged in a manner such that the lower end surface 42 of the body 28 of the bell housing 14 breaks through the fluid break surface, $F_{BS}$, the chamber 34 and second portion, $W_2$, of the workpiece, W, are isolated from atmospheric pressure, P.

Figure 1D:
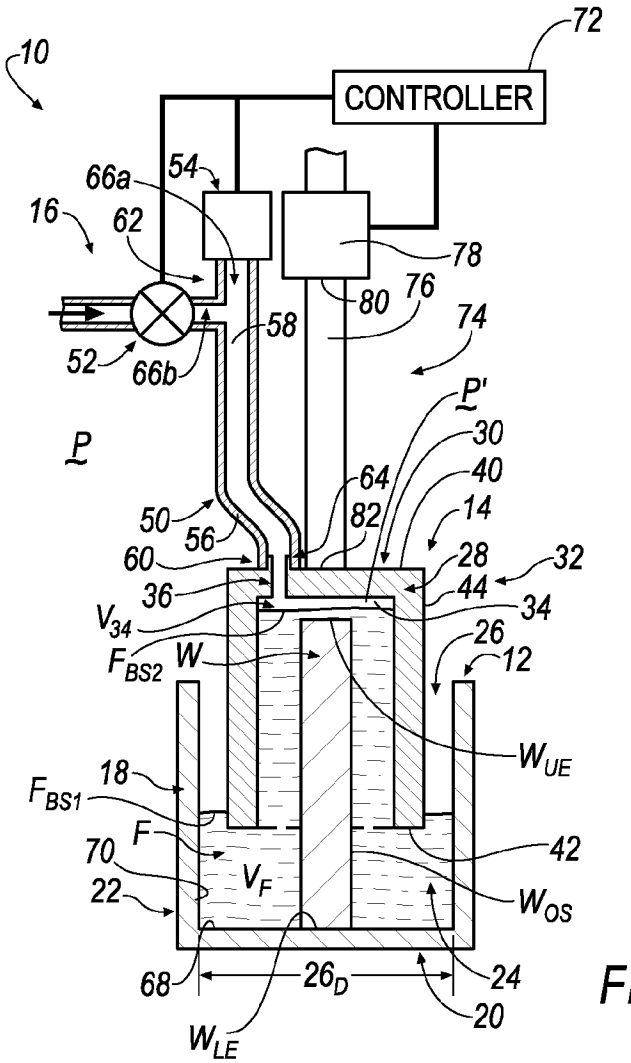
Figure 1C:
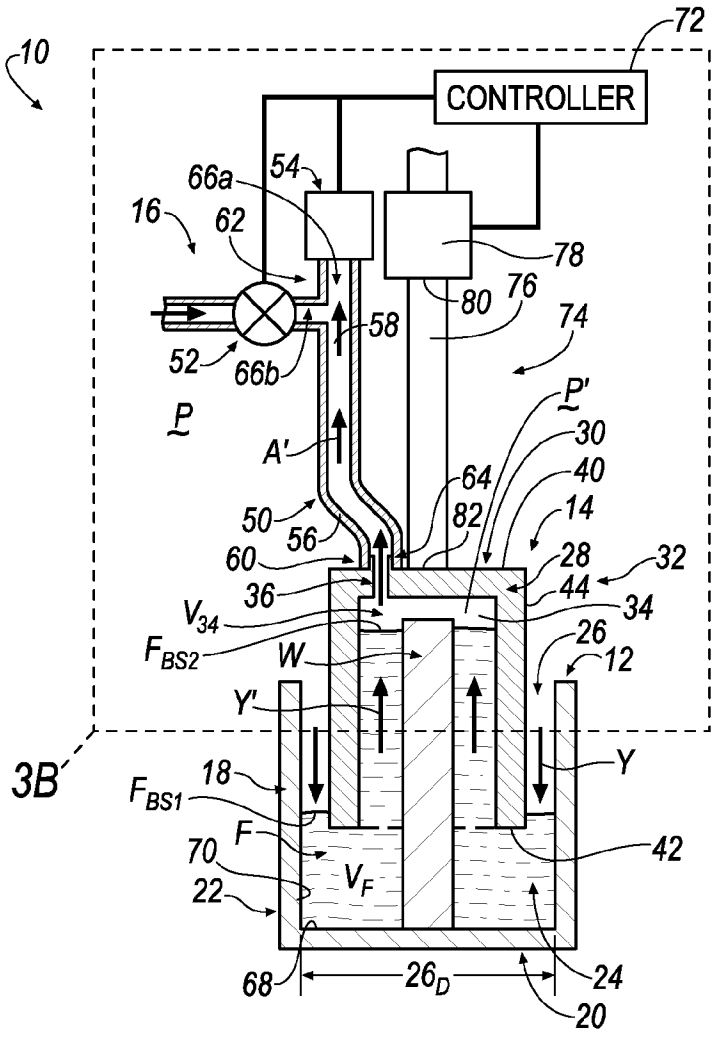

Referring to FIG. 1C, once the workpiece, W, and bell housing 14 are arranged as shown and described in FIG. 1B, the pressure manipulating sub-system 16 is actuated by the controller 72. Functionally, the pressure manipulating sub-system 16 changes the pressure within the volume, $V_{34}$, of the chamber 34 of the bell housing 14. By changing the pressure within the volume, $V_{34}$, of the chamber 34 of the bell housing 14, the fluid, F, may be drawn into (as seen, e.g., in a comparison of FIGS. 1B-1C) or evacuated out of (as seen, e.g., in a comparison of FIGS. 1D-1E) the volume, $V_{34}$, of the chamber 34 of the bell housing 14.

As seen in FIG. 1C, the controller 72 firstly sends a signal to the vacuum pump 54 in order to cause the vacuum pump 54 to switch from being "turned off" to being "turned on" (see, e.g., step S.104 in FIG. 5). When the vacuum pump 54 is turned on, the vacuum pump 54 (by way of the conduit 50) draws a fluid (e.g., air within the within the volume, $V_{34}$, of the chamber 34 of the bell housing 14) according to the direction of the arrow, A'. When the air is drawn out of the volume, $V_{34}$, of the chamber 34 of the bell housing 14, pressure, P', within the volume, $V_{34}$, of the chamber 34 of the bell housing 14 is reduced (when compared to atmospheric pressure, P); as a result, atmospheric pressure P, induces a downward force (according to the direction of the arrow, Y) upon the first fluid break surface portion, $F_{BS1}$.

When atmospheric pressure P, induces the downward force upon the first fluid break surface portion, $F_{BS1}$, according to the direction of the arrow, Y, the fluid, F, is displaced into the volume, $V_{34}$, of the chamber 34 of the bell housing 14 (see, e.g., step S.105 in FIG. 5). When the fluid, F, is displaced into the volume, $V_{34}$, of the chamber 34 of the bell housing 14, the second fluid break surface portion, $F_{BS2}$, rises according to the direction of the arrow, Y', which is opposite the direction of the arrow, Y, such that the fluid, F, is drawn into the volume, $V_{34}$, of the chamber 34 of the bell housing 14 and through the opening 26 formed in the body 18 of the fluid reservoir 12 such that at least a portion of the volume, $V_F$, of the fluid, F, is displaced out of the cavity 24 of the fluid reservoir 12.

Referring to FIG. 1D, the second fluid break surface portion, $F_{BS2}$, is raised in a manner such that the fluid, F, is ultimately drawn over the upper end, $W_{UE}$, of the workpiece, W. In an implementation, the fluid, F, may be drawn into the volume, $V_{34}$, of the chamber 34 of the bell housing 14 such that approximately the entire the volume, $V_{34}$, of the chamber 34 of the bell housing 14 is filled with the fluid, F.

As seen in FIG. 1D, once the fluid, F, is drawn over the upper end, $W_{UE}$, of the workpiece, W, it may be said that the workpiece, W, is fully submerged in the fluid, F (see, e.g., steps S.105, S.106, S.107 in FIG. 5). As a result, all of the outer surface, $W_{OS}$, of the workpiece, W, is coated, $F_C$ (see, e.g., FIG. 1F), with the fluid, F, such that the workpiece, W, may now be referred to as a coated workpiece, W' (see, e.g., FIG. 1F). Accordingly, once the workpiece, W, is fully submerged in the fluid, F, the controller 72 may send a signal to the vacuum pump 54 in order to cause the vacuum pump 54 to switch from being "turned on" to being "turned off" (see, e.g., step S.107 in FIG. 5). In an embodiment, once the workpiece, W, is fully submerged (see, e.g., steps S.105, S.106, S.107 in FIG. 5) in the fluid, F, the reduced pressure, P', within the volume, $V_{34}$, of the chamber 34 may be maintained for a period of time (see, e.g., steps S.108, S.109, S.110, S.111 in FIG. 5) such that the fully submerged workpiece, W, is permitted to soak in the fluid, F, in order to treat/develop the coating, $F_C$, on the workpiece, W, with the fluid, F, as desired.

Figure 1F:
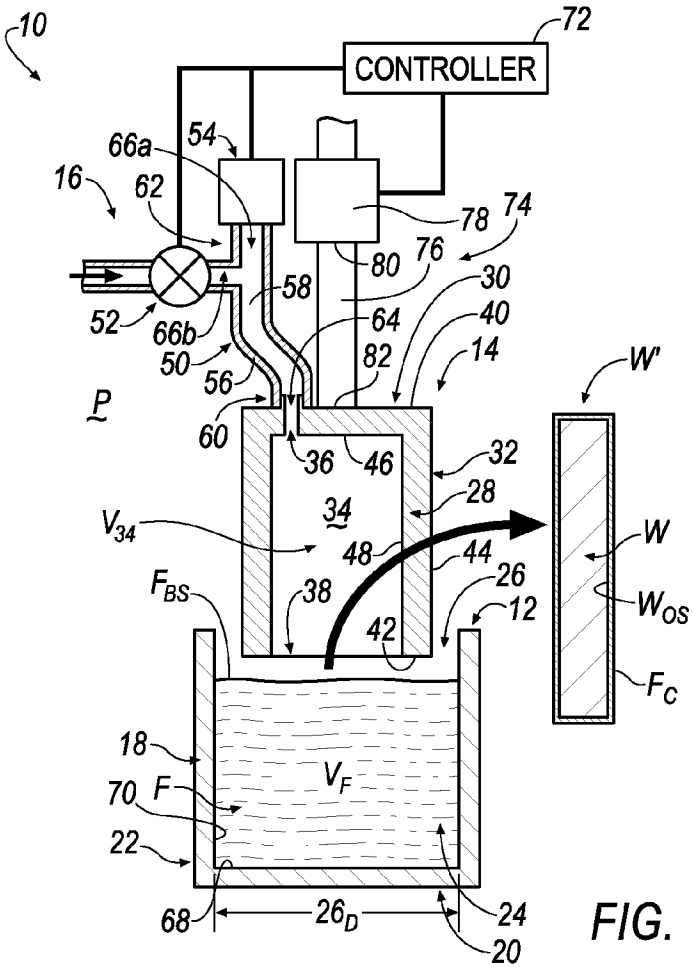
Figure 1E:
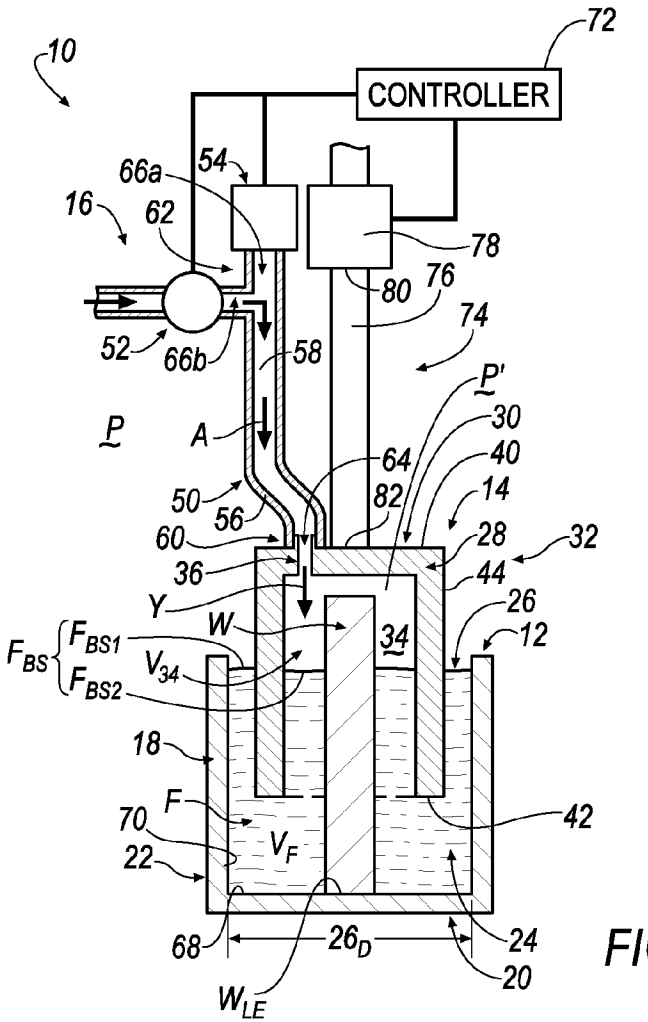

As seen in FIG. 1E, the controller 72 sends a signal to the valve 52 in order to cause the valve 52 to switch from being arranged in a "closed orientation" to being arranged in an "opened orientation" (see, e.g., step S.111 in FIG. 5) in order to permit the volume, $V_{34}$, of the chamber 34 of the bell housing 14 to be in fluid communication with atmospheric pressure, P. Because atmospheric pressure, P, is greater than the reduced pressure, P', within the volume, $V_{34}$, of the chamber 34 of the bell housing 14, when the valve 52 is arranged in the opened orientation, a fluid (e.g., ambient air under atmospheric pressure, P) is forced into the volume, $V_{34}$, of the chamber 34 of the bell housing 14 by way of the conduit 50 according to the direction of the arrow, A, which is opposite that of the direction of the arrow, A'.

When the air under atmospheric pressure, P, forces itself into the volume, $V_{34}$, of the chamber 34 of the bell housing 14, the second fluid break surface portion, $F_{BS2}$, is exposed to a downward force according to the direction of the arrow, Y. When atmospheric pressure P, induces the downward force upon the second fluid break surface portion, $F_{BS2}$, according to the direction of the arrow, Y, the fluid, F, is displaced out of the volume, $V_{34}$, of the chamber 34 of the bell housing 14. When the fluid, F, is displaced out of the volume, $V_{34}$, of the chamber 34 of the bell housing 14, the second fluid break surface portion, $F_{BS2}$, lowers according to the direction of the arrow, Y, such that the fluid, F, is evacuated out of the volume, $V_{34}$, of the chamber 34 of the bell housing 14 and through the opening 26 formed in the body 18 of the fluid reservoir 12 such that the portion of the volume, $V_F$, of the fluid, F, that was displaced out of the cavity 24 of the fluid reservoir 12 (as seen, e.g., in FIGS. 1C-1D) is deposited back into the cavity 24 of the fluid reservoir 12.

In an embodiment, the valve 52 and the vacuum pump 54 are shown as separate components with respect to the conduit 50 such that each of the valve 52 and vacuum pump 54 are in fluid communication with the conduit by the second openings 66*a*, 66*b*. However, it will be appreciated that the valve 52 and vacuum pump 54 may be included in a single unit and may be in fluid communication with the conduit 50 by one opening, which may be referred to as a second opening.

As seen in FIG. 1F, the controller 72 sends a signal to the plunging device 74 in order to cause the bell housing 14 to be returned to the at-rest, "up orientation" relative to the fluid reservoir 12 from the actuated, "down orientation" relative to the fluid reservoir 12 (see, e.g., step S.112 in FIG. 5). When the bell housing 14 is returned to at-rest, "up orientation," access to the opening 26 formed in the body 18 of the fluid reservoir 12 is provided in order to permit the coated workpiece, W', to be removed from the cavity 24 of the fluid reservoir 12 (see, e.g., step S.113 in FIG. 5).

In an embodiment, the workpiece, W, may include, for example, a pipe, and, in an embodiment, the fluid, F may include, for example, rust preventative solution, in order to yield a rust-preventative coat, $F_C$. Alternatively, the fluid, F, may include for example, a rust-stripping solution. Further, the fluid, F, may alternatively include a paint stripping solution. Although the workpiece, W, has been described above to include a pipe, it will be appreciated that the workpiece, W, is not limited to pipes and that the workpiece, W, may include any desirable object. Further, although the fluid, F, has been described above to include a rust prevention solution, a rust-stripping solution and a paint-stripping solution, it will be appreciated that the fluid, F, is not limited to the above solutions and that the fluid, F, may include any desirable solution.

Figure 6:
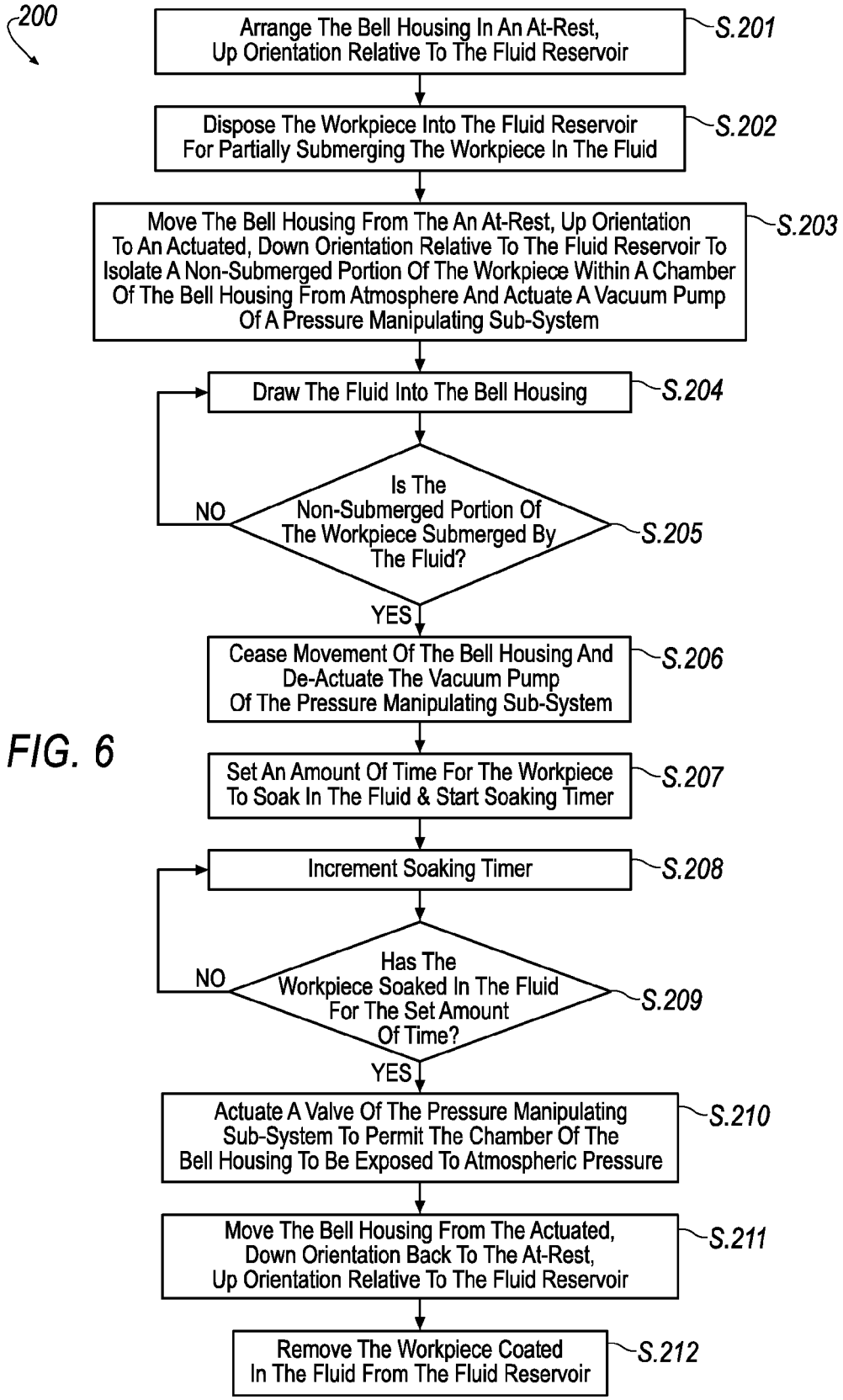
FIG. 6 illustrates a methodology associated with the system of FIGS. 2A-2F.

Referring now to FIGS. 2A-2F, a methodology 200 (see FIG. 6) in conjunction with the system 10 is described according to an embodiment. The methodology 200 is substantially similar to the methodology 100 with the exception of a compounded action of the pressure manipulating sub-system 16 and the plunging device 74 that is not present in the methodology 100.

Figure 2B:
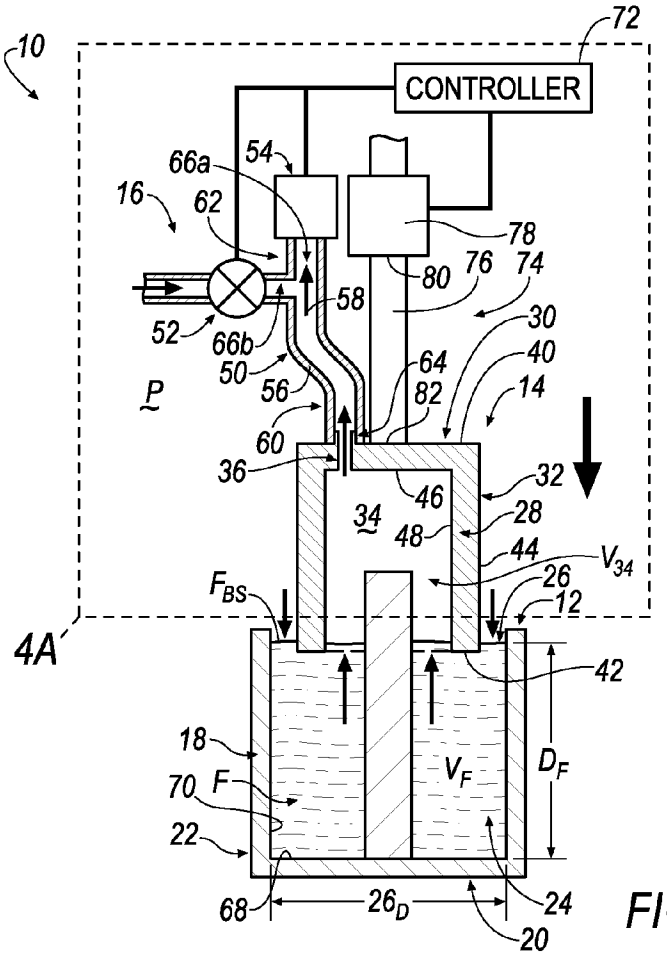
FIGS. 2A-2F illustrate partial cross-sectional views of a system including a workpiece submergable in a fluid.
Figure 2A:
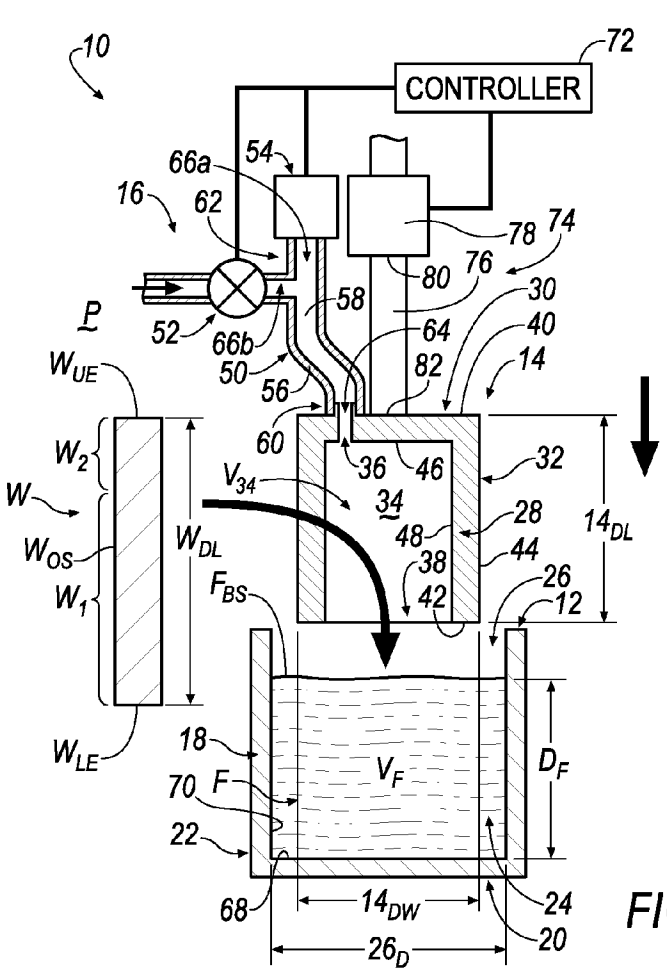
Figure 2D:
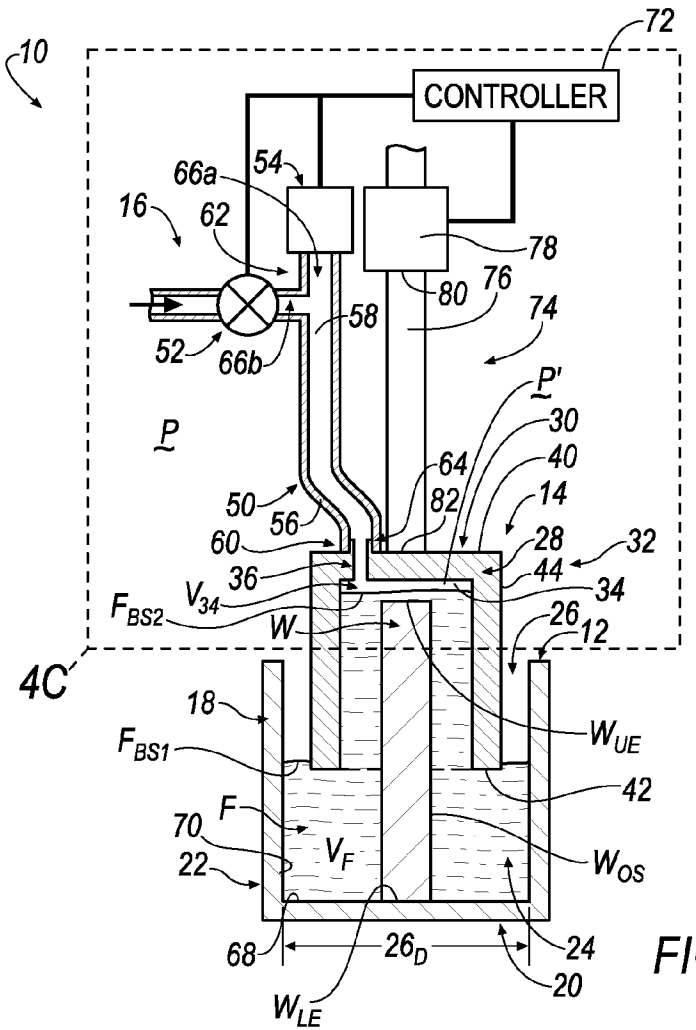
Figure 2C:
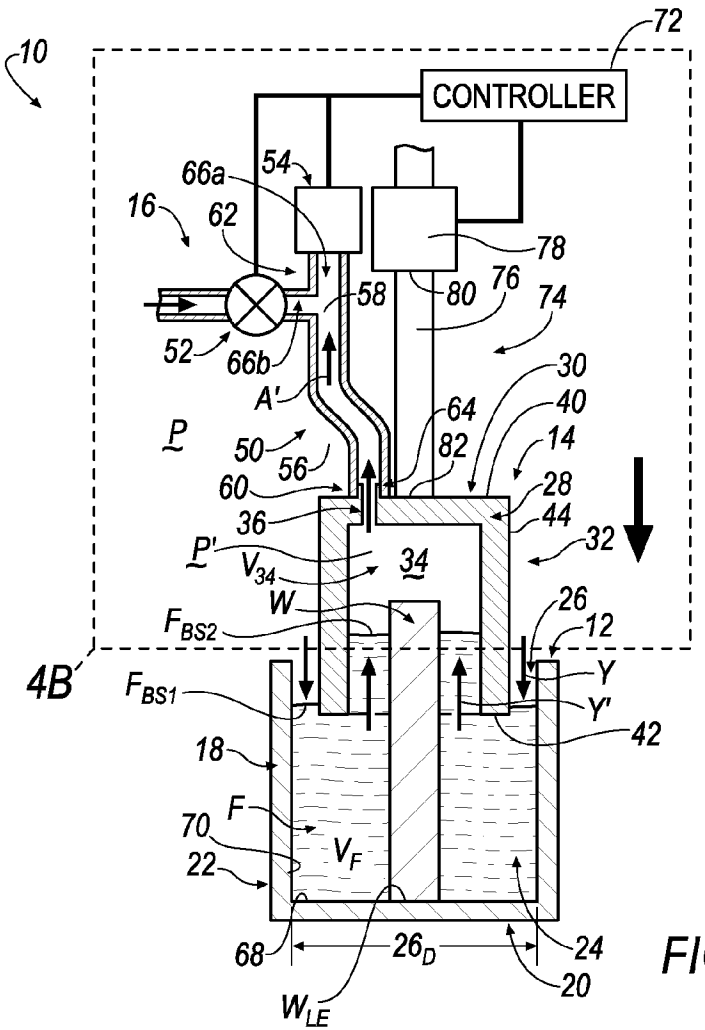
Figure 2F:
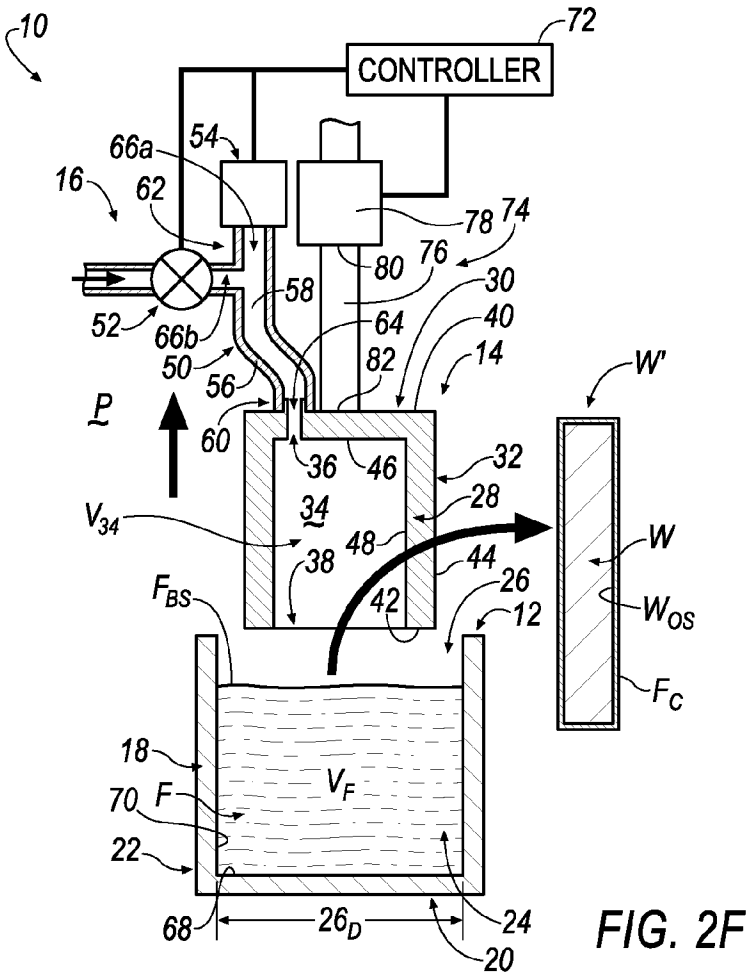
Figure 2E:
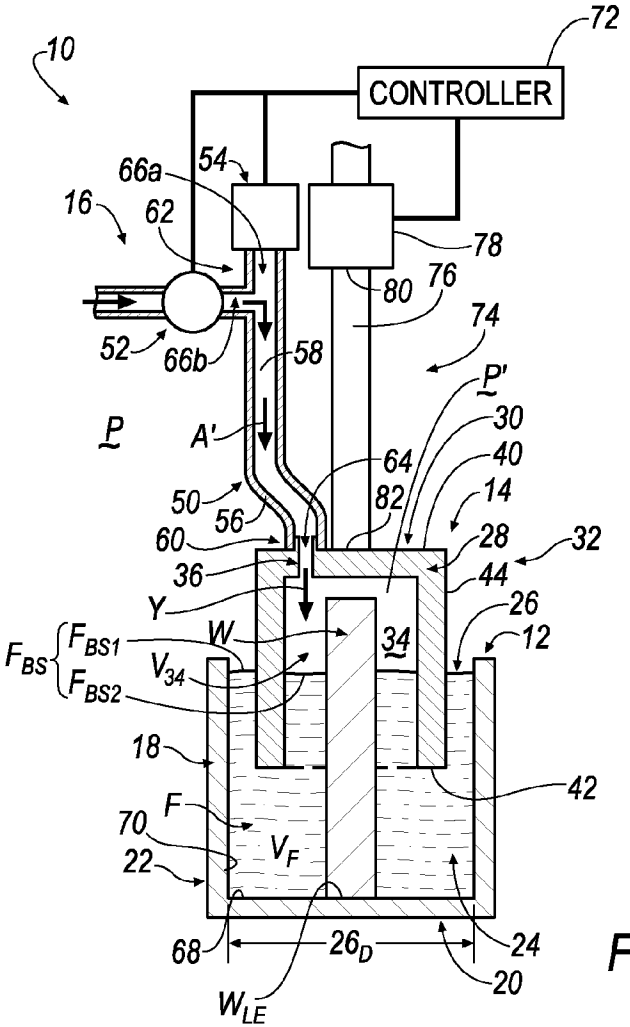
Figure 3B:
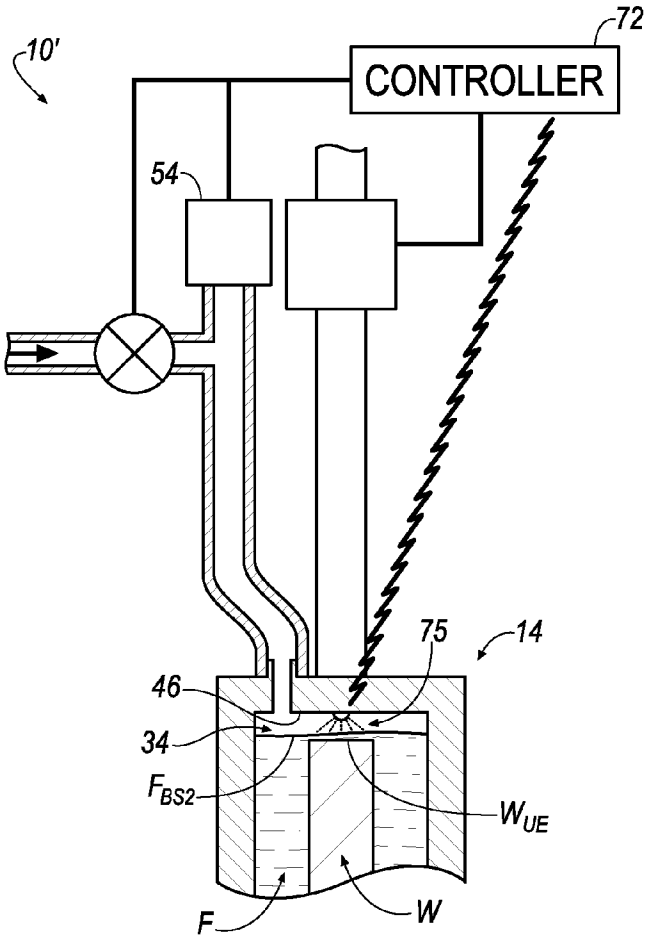
FIGS. 3A-3B illustrate enlarged views of an alternative embodiment of the system including a workpiece submergable in a fluid according to lines 3A, 3B of FIGS. 1B, 1C.
Figure 3A:
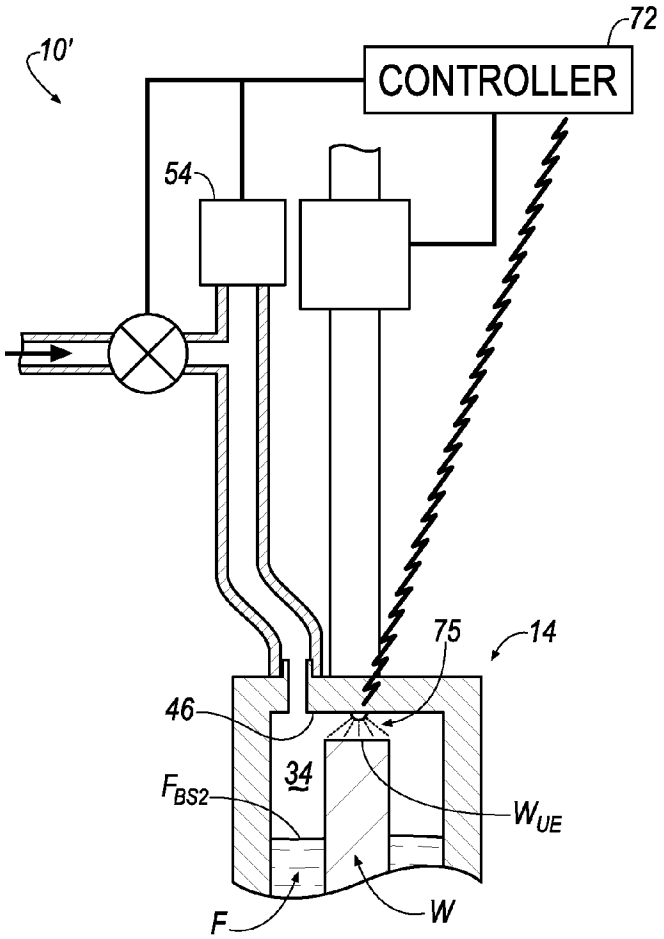
Figure 4C:
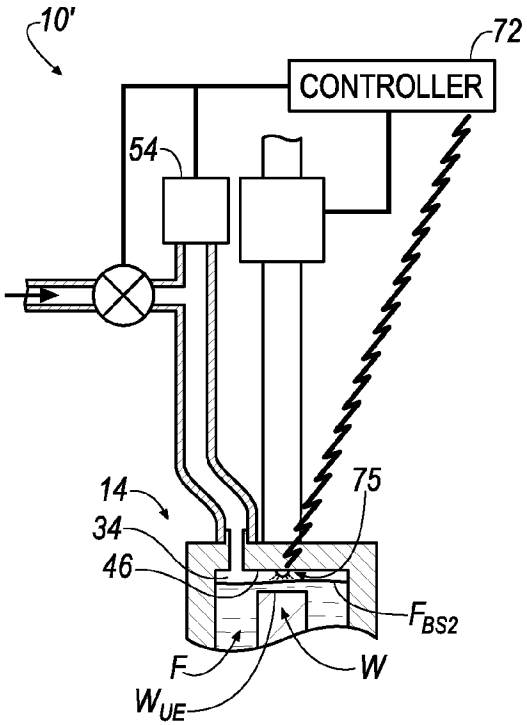
FIGS. 4A-4C illustrate enlarged views of an alternative embodiment of the system including a workpiece submergable in a fluid according to lines 4A-4C of FIGS. 2B-2D.
Figure 4B:
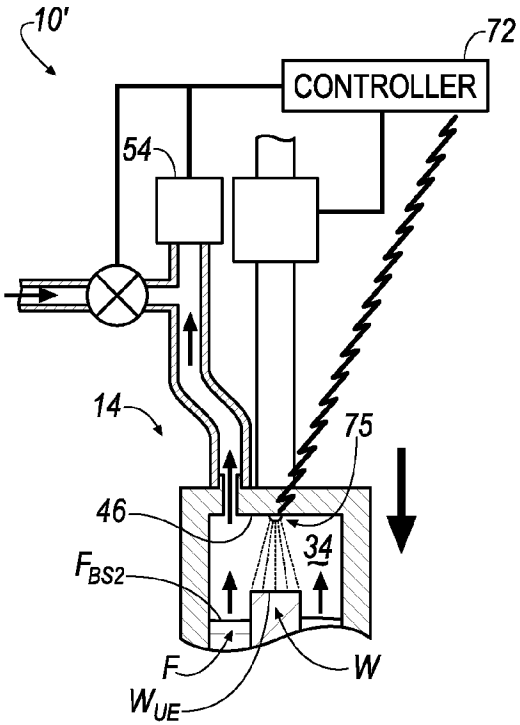
Figure 4A:
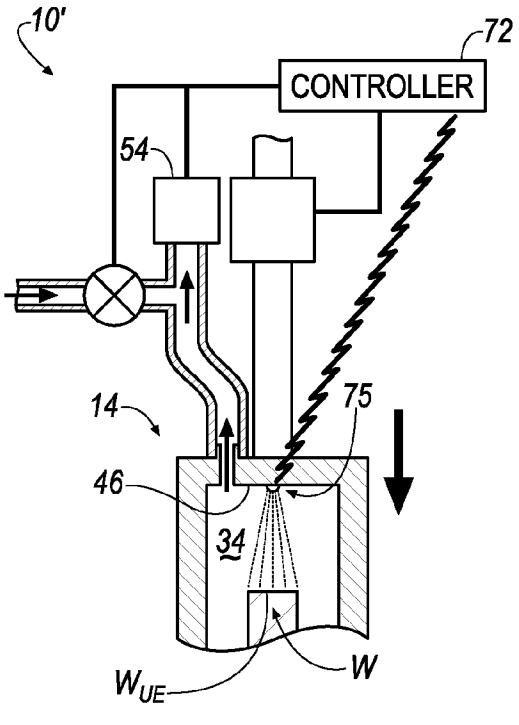

Referring to FIGS. 2B-2D, the controller 72 simultaneously operates both of the vacuum pump 54 of the pressure manipulating sub-system 16 and the plunging device 74 (see, e.g., step S.203 in FIG. 6) whereas the vacuum pump 54 of the pressure manipulating sub-system 16 and the plunging device 74 are sequentially acted upon on (see, e.g., steps S.103 and S.104 in FIG. 5) by the controller 72 as shown and described in FIGS. 1B and 1C. The simultaneous operation of the vacuum pump 54 of the pressure manipulating sub-system 16 and the plunging device 74 is described in an embodiment as follows. Firstly, the plunging device 74 is actuated in order to cause the bell housing 14 to move from the at-rest, "up orientation" relative to the fluid reservoir 12 to the actuated, "down orientation" relative to the fluid reservoir 12. Once the lower end surface 42 of the body 28 of the bell housing 14 breaks through the fluid break surface, $F_{BS}$, so as to isolate the chamber 34 and second portion, $W_2$, of the workpiece, W, from atmospheric pressure, P, the controller 72 actuates the vacuum pump 54. The controller 72 continues to cause the plunging device 74 to further advance the bell housing 14 from the at-rest, "up orientation" toward the actuated, "down orientation" as the vacuum pump 54 remains simultaneously turned on. Once the fluid, F, is drawn over the upper end, $W_{UE}$, of the workpiece, W, such that the workpiece, W, is fully submerged in the fluid, F, the controller 72 ceases further movement of the bell housing 14 from the at-rest, "up orientation" to the actuated, "down orientation" and switches the vacuum pump 54 from being turned on to being turned off (see, e.g., step S.206 in FIG. 6). Because the methodology 200 is otherwise substantially similar to the methodology 100, the remaining steps of the methodology 200 are not described here.

Referring to FIGS. 3A-3B and 4A-4C, a system 10' and methodologies 300, 400 are described according to an embodiment. The system 10' is substantially similar to the system 10 with the exception that the system 10' includes a sensor 75 that is disposed within the chamber 34 of the bell housing 14. In an embodiment the sensor 75 is disposed within the chamber 34 and adjacent the inner upper end surface 46 of the bell housing 14.

In an embodiment, the sensor 75 may wirelessly communicate with the controller 72. In an embodiment, the sensor 75 and controller 72 may communicate via a hard-wired connection.

In an embodiment, the sensor 75 communicates with the controller 72 in order to inform the controller 72 of the condition of one or more of the workpiece, W (see, e.g., the methodology 300), or the fluid, F (see, e.g., the methodology 400), within the volume, $V_{34}$, of the chamber 34 of the bell housing 14. In an embodiment, either of the methodologies 300, 400 may comprise some or all of the steps described at step S.106 in FIG. 5 or step S.205 in FIG. 6.

Figure 7:
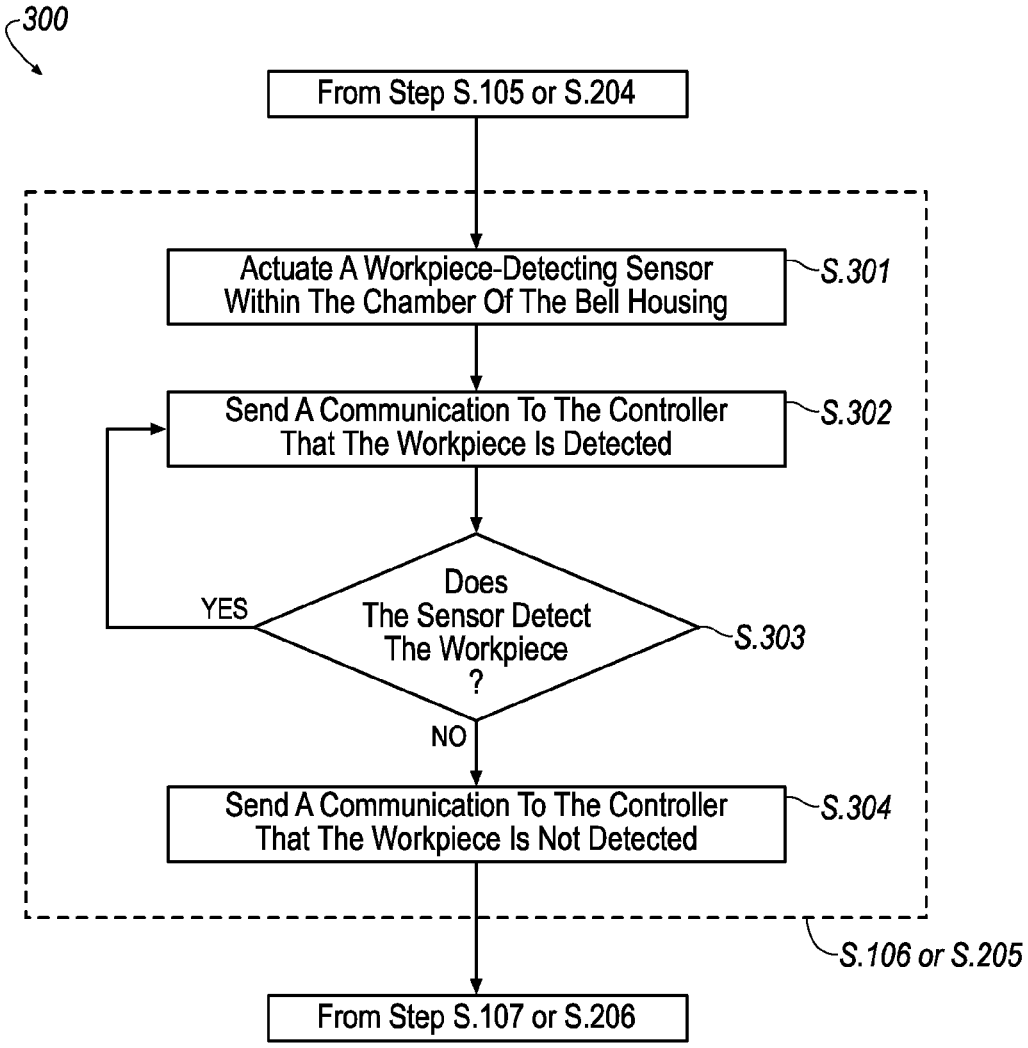
FIG. 7 illustrates a methodology associated with the enlarged views of FIG. 3A-3B or FIG. 4A-4C.

Referring to FIG. 7, the methodology 300 beings after step S.105 or step S.204 has concluded. In an embodiment, at step S.301, the sensor 75 is actuated and may focus on detecting the upper end, $W_{UE}$, of the workpiece, W (see, e.g., FIGS. 3A and 4A-4B); accordingly, when the fluid, F, fully submerges the workpiece, W (see, e.g., FIGS. 3B and 4C), the upper end, $W_{UE}$, of the workpiece, W, may be covered by the fluid, F, such that the sensor 75 may no longer be able to see or detect the upper end, $W_{UE}$, of the workpiece, W.

When the sensor 75 no longer sees or detects the upper end, $W_{UE}$, of the workpiece (see, e.g., steps S.302-S.304 in FIG. 7), W, the sensor 75 may send a signal to the controller 72 in order to inform the controller 72 that the workpiece, W, is fully submerged by the fluid, F. In response to receiving the communication from the sensor 75 the methodology 300 is advanced such that the controller 72 may: turn the vacuum pump 54 off (see, e.g., step S.107 in FIG. 5), or, simultaneously turn the vacuum pump 54 off and cease further plunging movement of the bell housing 14 (see, e.g., step S.206 in FIG. 6).

Figure 8:
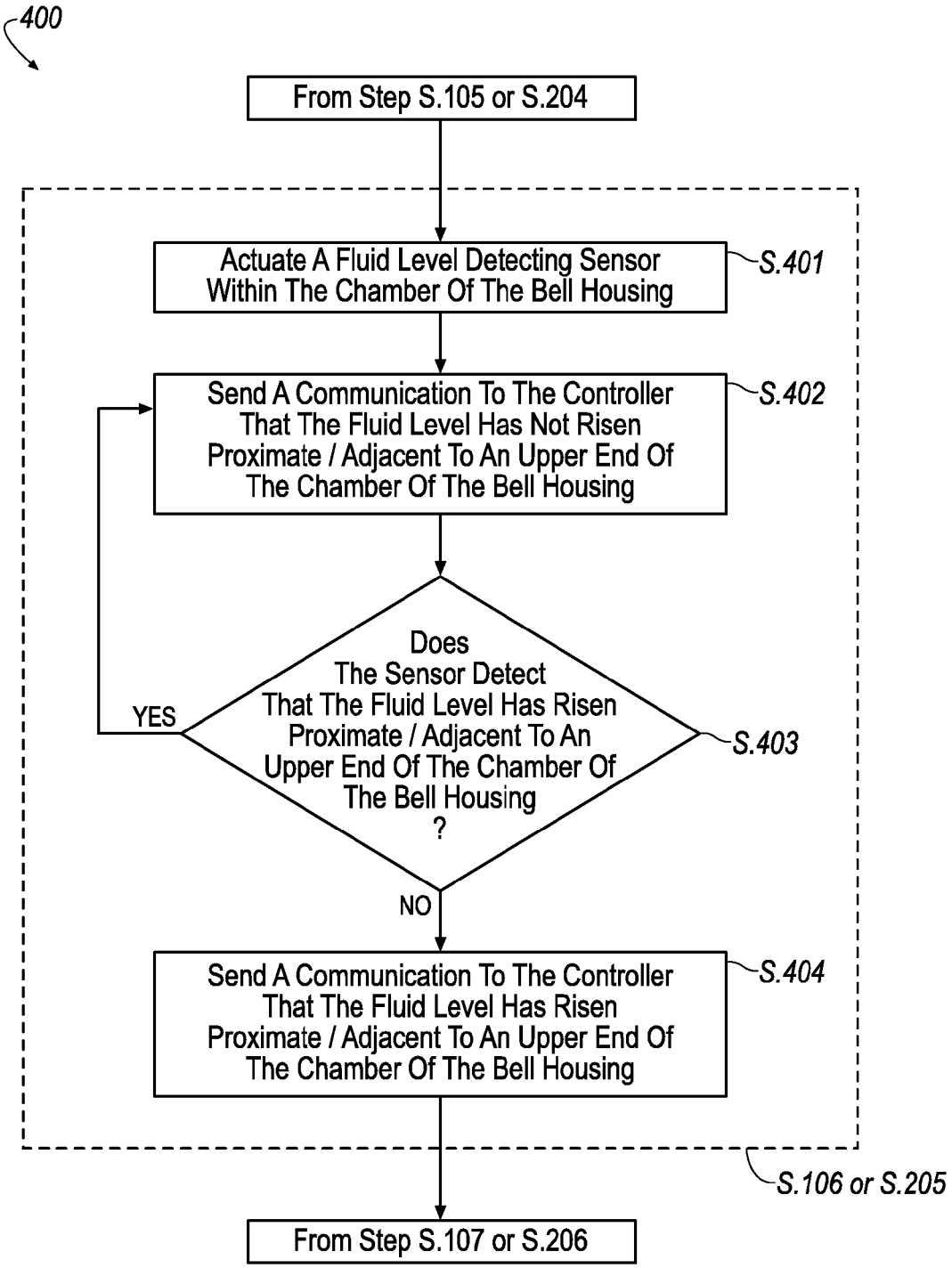
FIG. 8 illustrates a methodology associated with the enlarged views of FIG. 3A-3B or FIG. 4A-4C.

Referring to FIG. 8, the methodology 400 beings after step S.105 or step S.204 has concluded. In an embodiment, at step S.401, the sensor 75 is actuated and may focus on detecting a location of the second fluid break surface portion, $F_{BS2}$, relative to the inner upper end surface 46 of the bell housing 14. Accordingly, in an embodiment, when the sensor 75 detects that the second fluid break surface portion, $F_{BS2}$, has been raised in a manner such that the second fluid break surface portion, $F_{BS2}$, is substantially close or adjacent to the inner upper end surface 46 of the bell housing 14 (see, e.g., steps S.402-S.404 in FIG. 8), the sensor 75 may send a signal to the controller 72 in order to inform the controller 72 that the workpiece, W, is fully submerged by the fluid, F, due to the fluid, F, substantially filling the volume, $V_{34}$, of the chamber 34 of the bell housing 14 as a result of the second fluid break surface portion, $F_{BS2}$, having been raised such that the second fluid break surface portion, $F_{BS2}$, is substantially close or adjacent to the inner upper end surface 46 of the bell housing 14. In response to receiving the communication from the sensor 75, the methodology 400 is advanced such that the controller 72 may: turn the vacuum pump 54 off (see, e.g., step S.107 in FIG. 5), or, simultaneously turn the vacuum pump 54 off and cease further plunging movement of the bell housing 14 (see, e.g., step S.206 in FIG. 6).

With reference to FIGS. 9A-9E, a methodology 500 (see FIG. 10) in conjunction with a system 10" is described according to an embodiment. In an embodiment, the system 10" may further include a controller 72 for carrying out the methodology 500.

In an embodiment, the controller 72 may include, for example, logic circuitry for operating the system 10" in an automated manner. Alternatively, in an embodiment, the controller 72 may include, for example, one or more joysticks and buttons for operating the system 10" in a manual manner. Alternatively, in an embodiment, the controller 72 may include one or more of logic circuitry, joysticks, buttons or the like for operating the system 10" in a compounded automated/manual, or, one or more of a selectable automated and manual fashion.

Figure 9B:
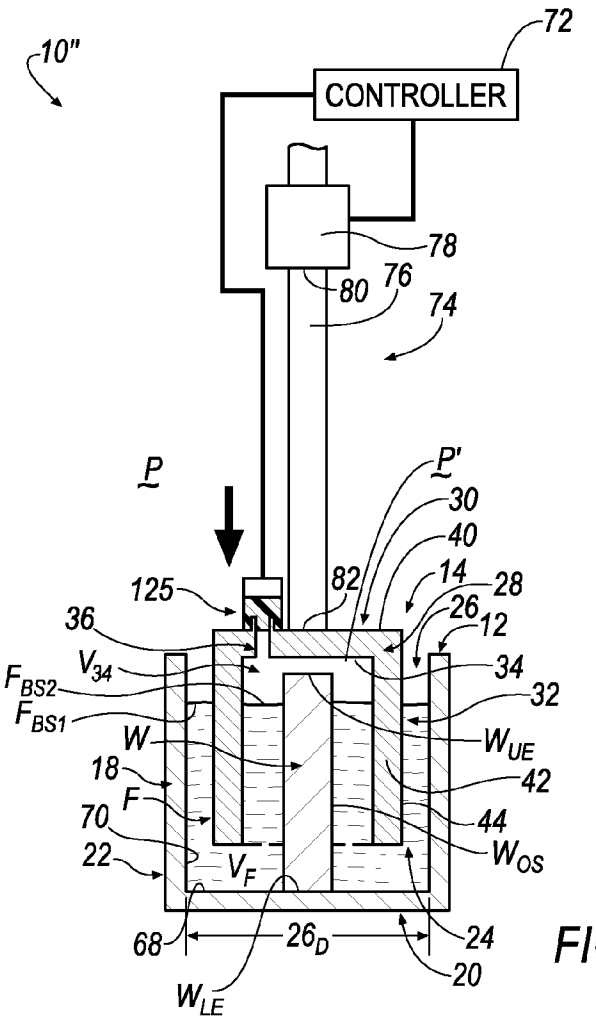
FIGS. 9A-9E illustrate partial cross-sectional views of a system including a workpiece submergable in a fluid.
Figure 9A:
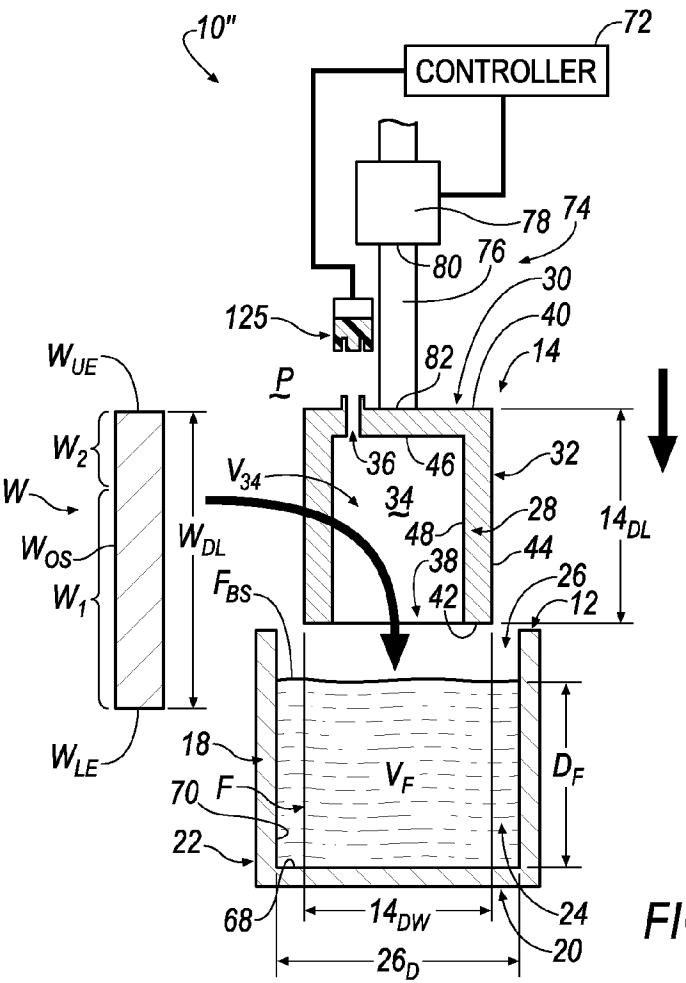
Figure 9D:
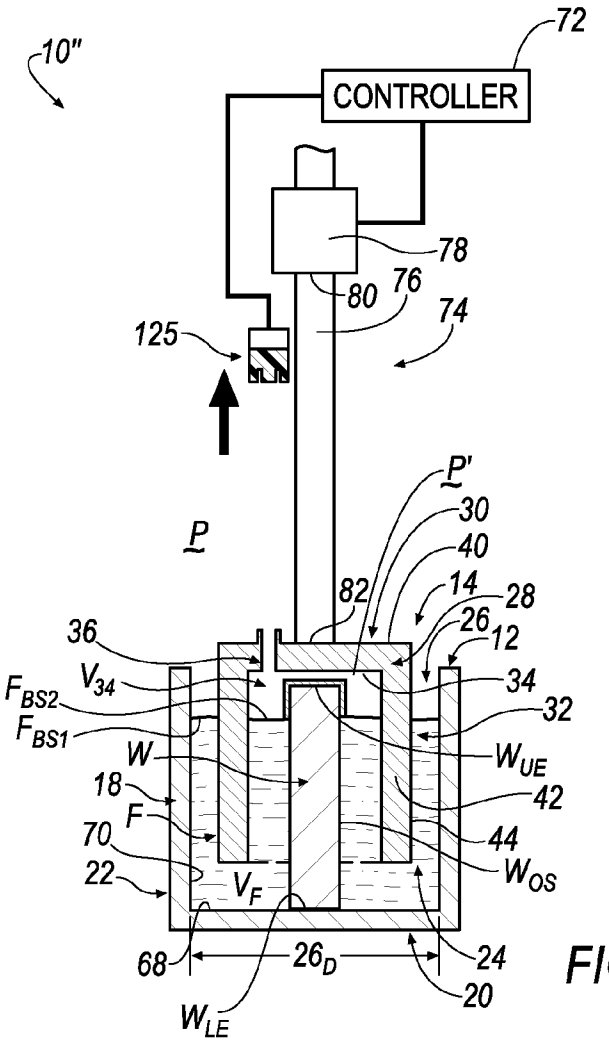
Figure 10:
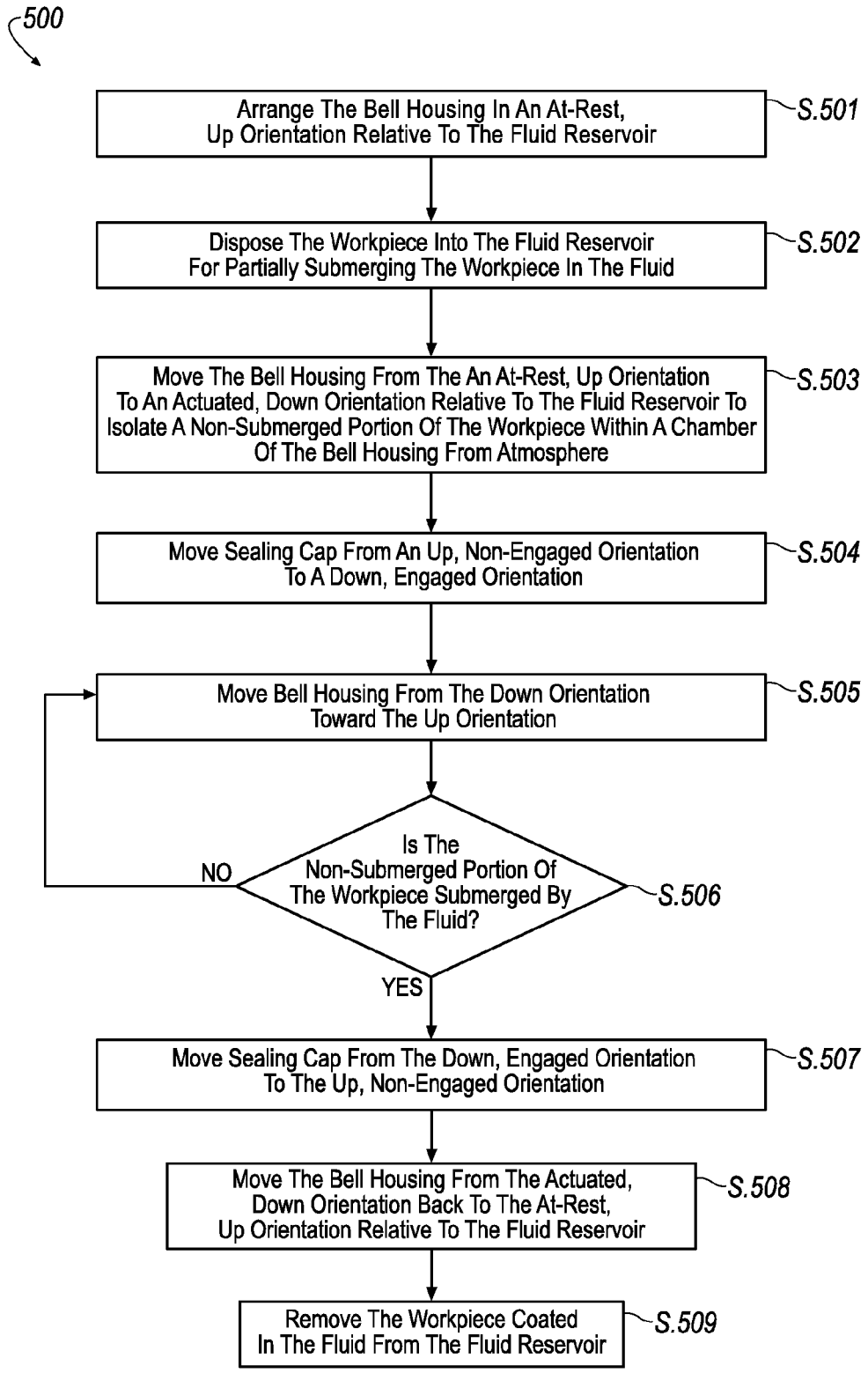
FIG. 10 illustrates a methodology associated with the system of FIGS. 9A-9E.

Referring initially to FIG. 9A, a bell housing 14 is arranged in an at-rest, "up orientation" relative to a fluid reservoir 12 (see, e.g., step S.501 in FIG. 10). Conversely, as seen in FIG. 9B, the bell housing 14 is arranged in an actuated, "down orientation" relative to the fluid reservoir 12 (see, e.g., step S.503 in FIG. 10). The up/down orientation of the bell housing 14 is carried out by a plunging device 74 that is connected to the controller 72.

In an embodiment, the plunging device 74 includes a boom 76 that is connected to a motor 78. The boom 76 includes an upper end 80 and a lower end 82. The upper end 80 of the boom 76 is connected to the motor 78 and the lower end 82 is connected to the outer upper end surface 40 of the body 28 of the bell housing 14.

Initially, the bell housing 14 is arranged in the at-rest, up orientation (see, e.g., step S.501 in FIG. 10) in order to provide access to an opening 26 formed in the body 18 of the fluid reservoir 12. Access to the opening 26 permits disposal of a workpiece, W, into the cavity 24 of the fluid reservoir 12.

The workpiece, W, is inserted into the cavity 24 (see, e.g., step S.502 in FIG. 10) such that a lower end, $W_{LE}$, of the workpiece, W, is permitted to break through the fluid break surface, $F_{BS}$, of the fluid, F. The workpiece, W, is advanced further into the fluid, F, until the lower end, $W_{LE}$, of the workpiece, W, contacts the inner surface 68 of the base portion 20 of the fluid reservoir 12.

As illustrated, the workpiece, W, includes a length dimension, $W_{DL}$. The length dimension, $W_{DL}$, is referenced from an upper end, $W_{UE}$, and the lower end, $W_{LE}$, of the workpiece, W. In an implementation, it desirable to fully submerge the workpiece, W, in the fluid, F, such that the fluid, F, may fully coat an outer surface, $W_{OS}$, of the workpiece, W; however, because the length dimension, $W_{DL}$, of the workpiece, W, is greater than the dimension, $26_D$, of the opening 26 formed in the body 18 of the fluid reservoir 12, a change of orientation of the workpiece, W, within the fluid reservoir 12 (i.e., changing the orientation of the workpiece, W, from a substantially "upright orientation" as illustrated to a "knocked down" or "side orientation") is physically impossible. Accordingly, upon disposing the workpiece, W, within the fluid reservoir 12, some of the workpiece, W, may extend through the opening 26 and out of the cavity 24 of the fluid reservoir 12. Thus, in an implementation, when the workpiece, W, is arranged, for example, in the substantially "upright orientation," a first portion, $W_1$ (see FIG. 9A), of the workpiece, W, may be submerged (see FIG. 9B) by the fluid, F, while a second portion, $W_2$ (see FIG. 9A), of the workpiece, W, may not be submerged (see FIG. 9B) by the fluid, F, and may extend out of the cavity 24 of the fluid reservoir 12.

Referring to FIG. 9B, in order to fully submerge the workpiece, W, in the fluid, F, the bell housing 14 is moved from the at-rest, "up orientation" to the actuated, "down orientation" (see, e.g., step S.503 in FIG. 10). When the bell housing 14 is moved to the down orientation, the lower end surface 42 of the body 28 of the bell housing 14 is permitted to break through the fluid break surface, $F_{BS}$, of the fluid, F. Further, when arranged in the "down orientation," some of the of the chamber 34 of the bell housing 14 may extend out of the cavity 24 and through the opening 26 and of the fluid reservoir 12 such that some of the volume, $V_{34}$, of the chamber 34 of the bell housing 14 is arranged within the cavity 24 while some of the volume, $V_{34}$, of the chamber 34 of the bell housing 14 is not arranged within the cavity 24.

Upon the lower end surface 42 of the body 28 of the bell housing 14 being arranged in a manner so as to break through the fluid break surface, $F_{BS}$, the fluid break surface, $F_{BS}$, is partitioned so as to form the first fluid break surface portion, $F_{BS1}$, and the second fluid break surface portion, $F_{BS2}$, as described above. Further, upon the lower end surface 42 of the body 28 of the bell housing 14 being arranged in a manner so as to break through the fluid break surface, $F_{BS}$, of the fluid, F, the second portion, $W_2$, of the workpiece, W, that is not submerged by the fluid, F, is arranged within the chamber 34 of the bell housing 14.

Once the bell housing 14 is arranged as shown in FIG. 9B, the controller 72 may cause movement (see, e.g., step S.504 in FIG. 10) of a sealing cap 125 from an "up, non-engaged orientation" (see, e.g., FIG. 9A) to a "down, engaged orientation" (see, e.g., FIG. 9B) for engaging the base portion 30 such that the sealing cap 125 closes-out the first opening 36 formed in the body 28 of the bell housing 14. By closing-out the first opening 36 with the sealing cap 125, when the second portion, $W_2$, of the workpiece, W, is arranged within the chamber 34 of the bell housing 14, and, when the bell housing 14 is arranged in a manner such that the lower end surface 42 of the body 28 of the bell housing 14 breaks through the fluid break surface, $F_{BS}$, the chamber 34 and second portion, $W_2$, of the workpiece, W, are isolated (see, e.g., P') from atmospheric pressure, P.

Figure 9C:
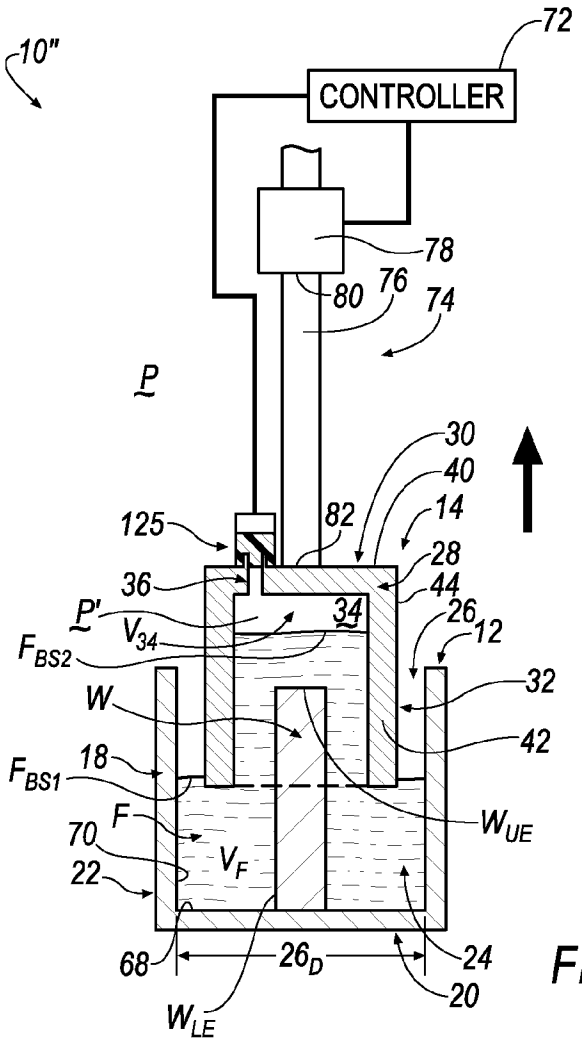

Referring to FIG. 9C, once the workpiece, W, and bell housing 14 are arranged as shown and described in FIG. 9B, the bell housing 14 is moved (see, e.g., step S.505 in FIG. 10) from the "down orientation" back toward the "up orientation." Because the sealing cap 125 isolates, P', the chamber 34 from atmospheric pressure, P, atmospheric pressure, P, is not permitted to exert a force or "push down" on the second fluid break surface portion, $F_{BS2}$, of the fluid, F, within the chamber 34; conversely, atmospheric pressure, P, is permitted to exert a force or "push down" on the first fluid break surface portion, $F_{BS1}$, that is exposed to atmospheric pressure, P. Accordingly, the fluid, F, that is trapped within the chamber 34 and not exposed to atmospheric pressure, P, is permitted to concurrently move with the bell housing from the "down orientation" back toward the "up orientation." As a result of the arrangement of the sealing cap 125, a pressure manipulating sub-system (see, e.g., pressure manipulating sub-system 16 described above) may not be incorporated with the system 10" for the purpose of drawing/evacuating the fluid, F, into/out of the volume, $V_{34}$, of the chamber 34 of the bell housing 14. Accordingly, as seen in FIG. 9C, the second fluid break surface portion, $F_{BS2}$, may be raised with the bell housing 14 in a manner such that the fluid, F, is ultimately moved, with the bell housing 14, over the upper end, $W_{UE}$, of the workpiece, W.

Once the fluid, F, is moved (see, e.g., step S.506 in FIG. 10) over the upper end, $W_{UE}$, of the workpiece, W, it may be said that the workpiece, W, is fully submerged in the fluid, F. As a result, all of the outer surface, $W_{OS}$, of the workpiece, W, is coated, $F_C$ (see, e.g., FIG. 9E), with the fluid, F, such that the workpiece, W, may now be referred to as a coated workpiece, W' (see, e.g., FIG. 9E).

Accordingly, once the workpiece, W, is fully submerged in the fluid, F, the controller 72 may send a signal to the sealing cap 125 in order to cause the sealing cap 125 to move (see, e.g., step S.507 in FIG. 10) from the "down, engaged orientation" (see, e.g., FIG. 9C) back to the "up, non-engaged orientation" (see, e.g., FIG. 9D) such that the sealing cap 125 no longer engages the base portion 30 such that the sealing cap 125 permits atmospheric pressure to communicate with the chamber 34 by way of the first opening 36 formed in the body 28 of the bell housing 14. As a result, atmospheric pressure, P, is permitted to exert a force or "push down" on the second fluid break surface portion, $F_{BS2}$, and evacuate the fluid, F, from within the chamber 34.

Figure 9E:
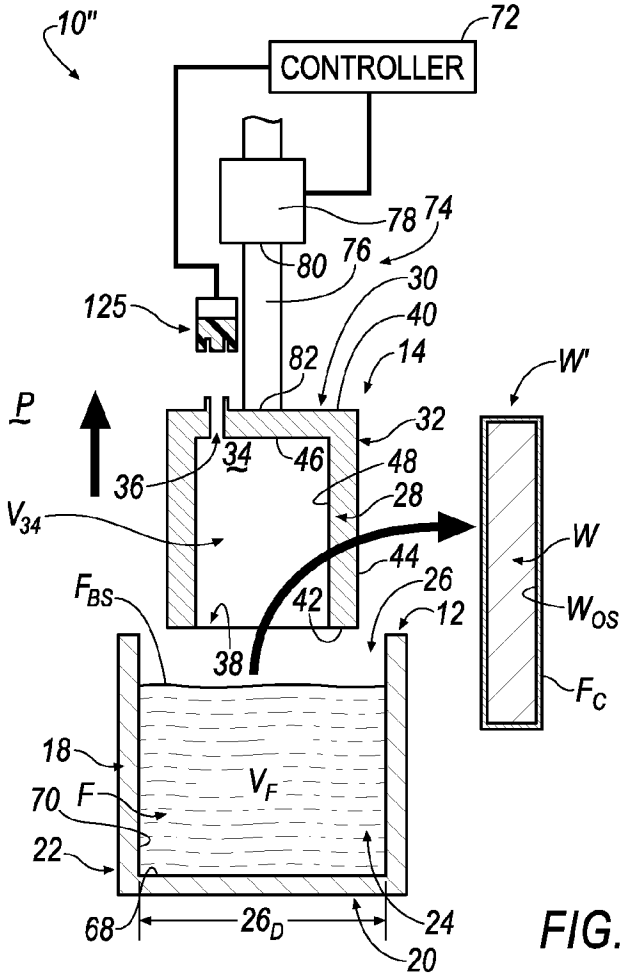

As seen in FIG. 9E, the controller 72 sends a signal to the plunging device 74 in order to cause the bell housing 14 to be returned (see, e.g., step S.508 in FIG. 10) to the at-rest, "up orientation" relative to the fluid reservoir 12 from the actuated, "down orientation" relative to the fluid reservoir 12 (see, e.g., step S.512 in FIG. 10). When the bell housing 14 is returned to at-rest, "up orientation," access to the opening 26 formed in the body 18 of the fluid reservoir 12 is provided in order to permit the coated workpiece, W', to be removed from the cavity 24 of the fluid reservoir 12 (see, e.g., step S.509 in FIG. 10).

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A method, comprising the steps of:

providing a fluid reservoir containing a volume of fluid;

providing a bell housing that forms a chamber;

providing a pressure manipulating sub-system in fluid communication with the chamber;

arranging a workpiece within the fluid reservoir for:

contacting a first surface portion of the workpiece with the fluid such that the first surface portion of the workpiece is submerged within the fluid, and arranging a second surface portion of the workpiece in a non-contacting orientation with the fluid such that the second surface portion of the workpiece is not submerged within the fluid; and arranging the bell housing relative to the fluid reservoir for:

partially submerging a lower end of the bell housing in the fluid for sealing the chamber from atmosphere, and disposing the second surface portion of the workpiece within the chamber that is sealed from atmosphere.

2. The method according to claim 1, further comprising the steps of:

actuating the pressure manipulating sub-system for:

drawing the fluid into the chamber that is sealed from atmosphere, submerging the second surface portion of the workpiece by the fluid, and maintaining the fluid within the chamber to sustain the submergence of the workpiece for a period of time to permit the fluid to coat the first surface portion and the second surface portion of the workpiece.

* * * * *